United States Patent [19]

Uesugi et al.

[11] Patent Number: 5,074,976

[45] Date of Patent: Dec. 24, 1991

[54] PROCESS FOR PRODUCING ALUMINUM SUPPORT FOR LITHOGRAPHIC PRINTING PLATE

[75] Inventors: Akio Uesugi; Tsutomu Kakei, both of Shizuoka, Japan

[73] Assignee: Fuji Photo Film Co., Ltd., Kanagawa, Japan

[21] Appl. No.: 553,342

[22] Filed: Jul. 16, 1990

Related U.S. Application Data

[63] Continuation of Ser. No. 270,584, Nov. 14, 1988, abandoned.

[30] Foreign Application Priority Data

Nov. 12, 1987 [JP] Japan ..... 62-284317
Nov. 25, 1987 [JP] Japan ..... 62-295135
Jul. 27, 1988 [JP] Japan ..... 63-185425

[51] Int. Cl.[5] ..... C25F 3/04

[52] U.S. Cl. ..... 204/129.35; 156/665; 204/129.4; 204/129.75; 205/214

[58] Field of Search ..... 204/27, 28, 33, 129.35, 204/129.4, 129.43, 129.75; 156/665

[56] References Cited

U.S. PATENT DOCUMENTS 4,166,015 8/1979 Raether ..... 204/129.75
4,272,342 6/1981 Oda et al. ..... 204/129.4
4,561,944 12/1985 Sasaki et al. ..... 204/33
4,576,686 3/1986 Hirokazu et al. ..... 204/33
4,851,091 7/1989 Uesugi et al. ..... 204/129.46

FOREIGN PATENT DOCUMENTS 57-16918 4/1982 Japan .

*Primary Examiner*—John Niebling
*Assistant Examiner*—William T. Leader
*Attorney, Agent, or Firm*—Sughrue, Mion, Zinn, Macpeak & Seas

[57] ABSTRACT

A process for producing an aluminum support for a lithographic printing plate is disclosed, which comprises etching a surface of an aluminum plate, particularly an aluminum plate containing manganese, with an alkali etching solution in such a manner that from 0.01 to 1.0 g/m$^2$ of aluminum is removed, chemically etching in an aqueous solution containing sulfuric acid in such a manner that from 0.001 to 5.0 g/m$^2$ of aluminum is removed, and subsequently subjecting the aluminum plate to electrolytic graining in an acidic electrolytic solution. The aluminum support has a uniform grain and provides a lithographic printing plate excellent in printing durability and stain resistance.

7 Claims, No Drawings

PROCESS FOR PRODUCING ALUMINUM SUPPORT FOR LITHOGRAPHIC PRINTING PLATE

This is a continuation of application Ser. No. 07/270,584 filed Nov. 14, 1988, now abandoned.

FIELD OF THE INVENTION

This invention relates to a process for producing an aluminum support for lithographic printing plates, and more particularly to a grained lithographic printing plate support comprising manganese-containing aluminum.

BACKGROUND OF THE INVENTION

Aluminum plates have been widely used as supports for printing plates, particularly lithographic printing plates. In conformity with variation of users' demands, the aluminum plate has shown more variety in composition, including from nearly pure aluminum with a very small content of impurities to aluminum alloys composed of aluminum as a main component. In particular, aluminum plates containing manganese have improved strength and have tended to increase in usage.

It is required for an aluminum plate to exhibit satisfactory adhesion to a photosensitive layer and water retention for use as a support for lithographic printing plates. To this effect, the surface of the aluminum plate should be roughened so as to have a uniform and dense grain. Suitability of the roughening process is a significant factor in production of printing plates, as it exerts significant influence upon the performance of a printing plate, such as stain resistance and printing durability.

Alternating current electrolytic graining is a generally employed process for roughening the surface of an aluminum plate for printing plates. Electrical current to be used in the electrolytic graining is a special alternating electric current, such as an ordinary sine wave current or a square wave current. In general, the alternating current electrolytic graining is preceded by etching treatment with an alkali, e.g., sodium hydroxide, to remove a surface layer of the aluminum plate as disclosed, e.g., in Japanese Patent Publication No. 57-16918.

However, such conventional etching treatment is unsatisfactory from the standpoint of obtaining a uniform surface roughness by the subsequent alternating electrolytic graining. This tendency is conspicuous in the case of using an aluminum plate containing manganese. More specifically, the conventional alkali etching has been effected until at least 3 g/m$^2$ of aluminum has been removed. However, etching to such a degree does not form a uniformly etched surface. In the case of using an aluminum plate containing 0.3% or more of manganese, etc., it is particularly difficult to uniformly etch the surface due to influences of intermetallic compounds, e.g., formed between aluminum and manganese, etc. As a result, the surface cannot be roughened uniformly by the subsequent alternating current electrolytic graining, resulting in adverse influences on printed image quality. Therefore, it has been desired to develop an effective etching technique as a treatment preceding alternating electrolytic current graining treatment.

SUMMARY OF THE INVENTION

One object of this invention is to provide a process for producing an aluminum support for lithographic printing plates in which an aluminum plate can be roughened uniformly by alternating current electrolytic graining.

Another object of this invention is to provide a process for producing an aluminum support which provides a lithographic printing plate exhibiting excellent printing performances.

As a result of extensive investigations, the inventors have found that the above objects of this invention can be accomplished by etching the surface of an aluminum plate with an alkali to a very limited extent prior to alternating current electrolytic graining.

That is, the present invention relates to a process for producing an aluminum support for a lithographic printing plate, which comprises etching a surface of an aluminum plate with an alkali etching solution to such a degree that from 0.01 to 5.0 g/m$^2$, preferably from 0.01 to 1.0 g/m$^2$, of aluminum is removed and subsequently subjecting the aluminum plate to electrolytic graining in an acidic electrolytic solution.

The present invention is particularly effective in case of using an aluminum plate containing from 0.3% to 3% by weight of manganese.

DETAILED DESCRIPTION OF THE INVENTION

The alkali etching solution preferably contains, as an alkali agent, sodium hydroxide, potassium hydroxide, sodium metasilicate, sodium carbonate, sodium aluminate, sodium gluconate, etc., at a concentration of from 0.001 to 5% by weight. The alkali etching is carried out at a temperature of from 20° to 90° C. for a period of from 1 second to 5 minutes.

If desired, the alkali-etched aluminum surface may be subjected to an etching treatment with an etching solution mainly comprising sulfuric acid prior to the electrolytic graining. By this etching treatment, intermetallic compounds formed by metals other than aluminum, such as manganese, contained in the aluminum plate, which are stuck to the surface of plate, are rendered acid-soluble and can be removed. The sulfuric acid concentration of the etching solution preferably ranges from 1 to 40% by weight. The etching is preferably effected at a temperature of from 20° to 80° C. for an appropriate period of time. A preferred amount to be etched out is from 0.001 to 5.0 g/m$^2$.

Subsequently, the aluminum surface is subjected to electrolytic graining in an acidic electrolytic solution using an alternating current. The electrolytic solution preferably includes hydrochloric acid, nitric acid and a mixture thereof, with nitric acid being more preferred. The nitric acid content in the electrolytic solution is generally in the range of from 0.1 to 10% by weight, and preferably from 0.3 to 3% by weight. The current wave can be selected appropriately depending on the shape of the desired grain.

The surface roughness obtained by the electrolysis varies depending on the quantity of electricity applied. The primary surface roughness formed by the electrolytic graining has a pit depth of from 0.1 to 10 μm and a pit diameter of from 0.2 to 20 μm, preferably a pit depth of from 2 to 4 μm, and a pit diameter of from 5 to 15 μm. Formation of such a pit diameter is preferably performed by the use of the special alternating wave current as disclosed in Japanese Patent Publication Nos. 56-19280 and 55-19191.

Thus, there can be obtained an aluminum support for lithographic printing plates having formed thereon primary surface roughness exhibiting adequate adhesiveness to a photosensitive layer and water retention properties. It is desirable that the resulting aluminum support is subjected to further treatments as described below.

The aluminum support having a primary surface roughness in accordance with the invention can be further treated with an acid or alkali solution. The acid solution to be used includes sulfuric acid as described in Japanese Patent Publication No. 56-11316, phosphoric acid, and a mixture of phosphoric acid and chromic acid. On the other hand, the alkali treatment comprises lightly etching the surface with an alkali solution, such as a sodium hydroxide aqueous solution, to remove smut that may be stuck to the surface. The alkali treatment sometimes leaves an alkali-insoluble matter; therefore, the alkali-treated aluminum plate is preferably desmutted again with an acidic solution, such as sulfuric acid, phosphoric acid, chromic acid, etc.

The acid- or alkali-treated aluminum plate may be subjected to a graining procedure as is used for formation of the primary surface roughness to form secondary surface roughness. The secondary surface roughness has a pit depth of 0.1 to 1 μm and a pit diameter of 0.1 to 5 μm, preferably a pit depth of 0.1 to 0.8 μm and a pit diameter of 0.1 to 3 μm.

Subsequent to the formation of the secondary surface roughness, the aluminum support is preferably treated with an acid or alkali solution in the same manner as described above. That is, the acid solution to be used includes sulfuric acid as described in Japanese Patent Publication No. 56-11316, phosphoric acid, and a mixture of phosphoric acid and chromic acid. On the other hand, the alkali treatment comprises lightly etching the surface with an alkali solution, such as a sodium hydroxide aqueous solution, to remove smut that may be stuck to the surface. Since the alkali treatment sometimes leaves an alkali-insoluble matter, the alkali-treated aluminum plate is preferably desmutted again with an acidic solution, such as sulfuric acid, phosphoric acid, chromic acid, etc. In the case of alkali-treatment, the aluminum plate is preferably subjected to desmutting with an acid solution in the same manner as described above.

Finally, the thus treated aluminum plate is anodically oxidized to form an anodic oxidation film having a thickness of from 0.1 to 10 g/m$^2$, and preferably from 0.3 to 5 g/m$^2$. The anodic oxidation is preferably preceded by alkali etching and desmutting.

The conditions for anodic oxidation are subject to variation according to an electrolytic solution used. In general, the electrolysis is suitably conducted at an electrolytic solution concentration of from 1 to 80% by weight, a liquid temperature of from 5° to 70° C., a current density of from 0.5 to 60 A/dm$^2$, a voltage of from 1 to 100 V, and an electrolysis time of from 10 seconds to 5 minutes.

The thus obtained grained aluminum support having an anodic oxidation film exhibits stability and excellent hydrophilic properties. While it can be used as a support for lithographic printing plates as it is to be coated with a photosensitive composition, the aluminum support may further be subjected to surface treatment. For example, a silicate layer may be provided by treating with an alkali metal silicate, or a subbing layer comprising a hydrophilic high-molecular weight compound may be provided thereon. The thickness of the subbing layer is preferably between 5 and 150 mg/m$^2$.

On the resulting aluminum support is coated a conventionally known photosensitive composition to form a photosensitive layer to prepare a presensitized lithographic printing plate precursor. A printing plate is produced from the precursor by imagewise exposure to light and development.

The present invention is now illustrated in greater detail by way of the following Examples and Comparative Examples, but it should be understood that the present invention is not deemed to be limited thereto. In these examples, all the percents are by weight unless otherwise indicated.

EXAMPLE 1

A JIS 3003 aluminum plate containing 1.2% manganese was soaked in a 10% sodium hydroxide aqueous solution warmed at 60° C. until 3 g/m$^2$ of aluminum were etched out. After washing with water, the aluminum plate was soaked in a 30% sulfuric acid aqueous solution warmed at 60° C. until 0.05 g/m$^2$ of aluminum were etched out. After washing with water, the aluminum plate was subjected to electrochemical graining in a 1.3% nitric acid aqueous solution using an alternating current as described in Japanese Patent Publication No. 55-19191 under electrolysis conditions of $V_A$=12.6 V, $V_C$=9.0 V, and an anodic electric amount of 500 coulomb/dm$^2$. Subsequently, the smut on the surface of the plate was removed. The electron micrograph of the plate surface showed that large pits of about 10 μm and fine pits of about 1 μm were uniformly formed. Thereafter, an anodic oxidation film having a thickness of 2.3 g/m$^2$ was formed in a 20% sulfuric acid aqueous solution, followed by washing with water and drying. The resulting support was designated as (A).

COMPARATIVE EXAMPLE 1

A JIS 3003 aluminum plate containing 1.2% manganese was soaked in a 10% sodium hydroxide aqueous solution warmed at 60° C. until 3 g/m$^2$ of aluminum was etched out. After washing with water, the plate was desmutted and neutralized with a 10% nitric acid aqueous solution. After washing with water, the plate was subjected to electrochemical graining in the same manner as in Example 1. The electron micrograph of the surface of the aluminum plate revealed that large pits of about 40 μm were non-uniformly formed and that a large area remained unetched. Thereafter, an anodic oxidation film having a thickness of 2.3 g/m$^2$ was formed in a 20% sulfuric acid aqueous solution, followed by washing with water and drying. The resulting support was designated as (B).

On each of the supports (A) and (B) was coated a photosensitive composition having the following formulation to a dry thickness of 2.0 g/m$^2$.

| Formulation of Photosensitive Composition: | |
|---|---|
| Ester compound of naphthoquinone-1,2-diazido-5-sulfonyl chloride; pyrogallol and an acetone resin (described in Example 1 of U.S. Pat. No. 3,635,709) | 0.75 g |
| Cresol novolak resin | 2.00 g |
| Oil Blue #603 (an oil-soluble blue blue dye produced by Orient Chemical Co., Ltd.) | 0.04 g |
| Ethylene dichloride | 16 g |
| 2-Methoxyethyl acetate | 12 g |

The resulting presensitized lithographic printing plate precursor was brought into intimate contact with a transparent positive film and exposed to light emitted from a 3 kW metal halide lamp placed 1 m away for 50 seconds through the film in a vacuum printer and then developed with a 5.26% aqueous solution of sodium silicate ($SiO_2/Na_2O$ molar ratio=1.74) (pH=12.7).

The thus prepared lithographic printing plate was mounted on a printing machine ("Sprint 25" manufactured by Komori Insatsuki KK), and printing was carried out in a conventional manner to evaluate press life (printing durability) and stain resistance. The results obtained are shown in Table 1 below.

TABLE 1

| | Example 1 | Comparative Example 1 |
|---|---|---|
| Support | (A) | (B) |
| Press Life | 150,000 prints | 60,000 prints |
| Stain Resistance | excellent | practical |

It can be seen that an aluminum support having a uniform grain and capability of producing a printing plate having satisfactory printing performance properties can be obtained by alkali etching, followed by chemical etching in an aqueous solution mainly comprising sulfuric acid, and followed by electrolytic graining in an acidic electrolytic solution.

EXAMPLE 2

A JIS 3003 aluminum plate containing 1.1% manganese was soaked in a 1% sodium hydroxide aqueous solution warmed at 30° C. to etch out 0.1 g/m$^2$ of aluminum. After washing with water, the plate was soaked in a 3% nitric acid aqueous solution, followed by thoroughly washing with water. Thereafter, the plate was subjected to electrochemical graining in a 1.5% nitric acid aqueous solution by using an alternating current described in Japanese Patent Publication No. 55-19191 under electrolysis conditions of $V_A$=12.7 V, $V_C$=9.1 V, and an anodic electric amount of 600 coulomb/dm$^2$. The smut on the surface was then removed. An electron micrograph of the surface revealed that large pits of about 10 μm diameter and fine pits of about 1 μm diameter were uniformly formed.

The resulting support was subjected to anodic oxidation in a 20% sulfuric acid aqueous solution to form an anodic oxidation film of 2.5 g/m$^2$, followed by washing with water and drying. The resulting support was designated as (C).

COMPARATIVE EXAMPLE 2

A JIS 3003 aluminum plate containing 1.2% manganese was soaked in a 10% sodium hydroxide aqueous solution warmed at 60° C. to etch out 5 g/m$^2$ of aluminum. After washing with water, the plate was soaked in a 10% nitric acid aqueous solution, followed by thoroughly washing with water.

The aluminum plate was subjected to surface roughening in the same manner as in Example 2, followed by desmutting. An electron micrograph of the surface revealed that large non-uniform pits of about 30 μm were formed and that a large unetched area (i.e., the area where manganese had been deposited) remained.

The resulting aluminum support was anodically oxided in an 20% sulfuric acid aqueous solution to form 2.5 g/m$^2$ of an anodic oxidation film, followed by washing with water and drying. This support was designated as (D).

Each of the resulting supports (C) and (D) was coated with a photosensitive composition of the following formulation to a dry thickness of 2.0 g/m$^2$ to form a photosensitive layer.

| Formulation of Photosensitive Composition: | |
|---|---|
| N-(4-Hydroxyphenyl)methacrylamide/2-hydroxyethyl methacrylate/acrylonitrile/methyl methacrylate/methacrylic acid acid copolymer (15:10:30:38:7 by mol; average molecular weight: 60,000) | 5.0 g |
| Hexafluorophosphate of a condensate between 4-diazodiphenylamine and formaldehyde | 0.5 g |
| Phosphorous acid | 0.05 g |
| Victria Pure Blue BOH (a dye produced by Hodogaya Chemical Co., Ltd.) | 0.1 g |
| 2-Methoxyethanol | 100 g |

The resulting printing plate precursor was exposed to light emitted from a 3 kW metal halide lamp from a distance of 1 m for 50 seconds through a transparent negative film in a vacuum printer, developed with a developer having the following formulation, and gummed up with a gum arabic aqueous solution to produce a lithographic printing plate.

| Formulation of Developer: | |
|---|---|
| Sodium sulfite | 5 g |
| Benzyl alcohol | 30 g |
| Sodium carbonate | 5 g |
| Sodium isopropylnaphthalenesulfonate | 12 g |
| Pure water | 1,000 ml |

The thus prepared lithographic printing plate was used for printing in a usual manner. The results obtained are shown in Table 2.

TABLE 2

| | Example 2 | Comparative Example 2 |
|---|---|---|
| Support | (C) | (D) |
| Press Life | 100,000 prints | 80,000 prints |
| Stain Resistance | satisfactory | not practical |

EXAMPLE 3

A JIS 1100 aluminum plate (Al purity: 99% or more) was subjected to electrochemical graining in the same manner as in Example 2. After desmutting, the roughened surface was observed through its electron micrograph. As a result, it was found that large pits of about 15 μm and fine pits of about 1 μm were uniformly formed. An anodic oxidation film having a thickness of 2.5 g/m$^2$ was formed thereon in a 20% sulfuric acid aqueous solution, followed by washing with water and drying. The resulting support was designated as (E).

COMPARATIVE EXAMPLE 3

A JIS 1100 aluminum support was subjected to electrochemical graining in the same manner as in Comparative Example 2. After desmutting, the surface was observed through its electron micrograph. As a result, it was found that large non-uniform pits of about 25 μm were formed. An anodic oxidation film having a thickness of 2.5 g/m$^2$ was formed thereon in a 20% sulfuric acid aqueous solution, followed by washing with water and drying. The resulting support was designated as (F).

On each of the resulting supports (E) and (F) was coated with the same photosensitive composition as used for supports (C) and (D) and dried, and exposed to light and developed in the same manner as for supports (C) and (D) to produce a lithographic printing plate. The printing plate was used for printing in a usual manner, and the results obtained are shown in Table 3.

TABLE 3

| | Example 3 | Comparative Example 3 |
|---|---|---|
| Support | (E) | (F) |
| Press Life | 150,000 prints | 90,000 prints |
| Stain Resistance | satisfactory to practical | not practical |

As described above, an aluminum support having a uniform grain and capability of providing a lighographic printing plate excellent in printing performance can be obtained by alkali etching to an etched aluminum amount of from 0.01 to 1.0 g/m$^2$, followed by electrolytic graining in an acidic electrolytic solution.

While the invention has been described in detail and with reference to specific embodiments thereof, it will be apparent to one skilled in the art that various changes and modifications can be made therein without departing from the spirit and scope thereof.

What is claimed is:

1. A process for producing an aluminum support for a lithographic printing plate, which comprises etching a surface of an aluminum plate containing at least 0.3% by weight of manganese with an alkali etching solution such that from 0.01 to 1.0 g/m$^2$ of aluminum is removed, chemically etching the alkali-etched aluminum plate in an aqueous solution containing sulfuric acid in an amount of from 1 to 40% by weight to remove from 0.001 to 5.0 g/m$^2$ of aluminum, and subsequently subjecting the aluminum plate to electrolytic graining in an acidic electrolytic solution, wherein said alkali etching is carried out at an alkali agent concentration of from 0.001 to 5 % by weight, at a temperature of from 20° to 90° C., for a period of from 1 second to 5 minutes.

2. A process as in claim 1, wherein said aluminum plate contains from 0.3% to 3% by weight of manganese.

3. A process as in claim 1, wherein said temperature is within a range of from 20° to 80° C.

4. A process in claim 1, wherein said acidic electrolytic solution is an aqueous solution containing nitric acid in an amount of from 0.1 to 10% by weight.

5. A process as in claim 1, wherein said etching in an aqueous solution containing sulfuric acid is carried out at a temperature of from 20° to 80° C.

6. A process as in claim 1, wherein said electrolytic graining provides a primary surface roughness having a pit depth of from 0.1 to 10 μm and a pit diameter of from 0.2 to 20 μm.

7. A process as in claim 6, further comprising electrolytically graining the electrolytically grained aluminum plate having a primary surface roughness in an acidic solution to provide a secondary surface roughness having a pit depth of from 0.1 to 1 μm and a pit diameter of from 0.1 to 5 μm.

* * * * *